US005842564A

United States Patent [19]

Clement

[11] Patent Number: 5,842,564

[45] Date of Patent: Dec. 1, 1998

[54] HOLDER FOR GOLF CLUBS

[76] Inventor: Charles R. Clement, 960 Crossroads Blvd., Sequin, Tex. 78155

[21] Appl. No.: 933,491

[22] Filed: Sep. 18, 1997

[51] Int. Cl.[6] ..... A63B 55/00

[52] U.S. Cl. ..... 206/315.2; 206/315.6

[58] Field of Search ..... 211/70.2; 206/315.2, 206/315.3, 315.6

[56] References Cited

U.S. PATENT DOCUMENTS

| | | | |
|---|---|---|---|
| 4,383,563 | 5/1983 | Kirchhoff, Jr. | 206/315.5 X |
| 4,673,082 | 6/1987 | Hemme | 211/70.2 X |
| 4,852,896 | 8/1989 | Mills | 206/315.6 X |
| 5,188,243 | 2/1993 | Ruiz | 211/70.2 |
| 5,226,533 | 7/1993 | Antonious | 206/315.6 |
| 5,465,840 | 11/1995 | Joh | 206/315.6 |
| 5,624,028 | 4/1997 | Shin et al. | 206/315.5 X |

*Primary Examiner*—Jes F. Pascua
*Assistant Examiner*—Tri M. Mai
*Attorney, Agent, or Firm*—Timothy T. Tyson; Ted Masters; Freilich, Hornbaker & Rosen

[57] ABSTRACT

A holder (20) for golf clubs includes an upper rack (22) for woods, a lower rack (44) for irons, and a central support tube (36). Woods are downwardly inserted into sockets (26) in the upper rack (22) with the club shafts and grips residing inside the support tube (36). Mesas (30) on the upper rack (22) capture the head of the wood and prevent it from rotating or otherwise contacting the heads of adjacent clubs. Irons are downwardly inserted into sockets (58) in the lower rack (44). In the playing position, the blade (600) of the iron protrudes outwardly from the lower rack (44) for easy access. In the storage position, the blade (600) of the iron is retained by a pair of pegs (60). A centering means (40) is attached to the support tube (36) to keep the holder 20 centered within a golf bag 700.

14 Claims, 10 Drawing Sheets

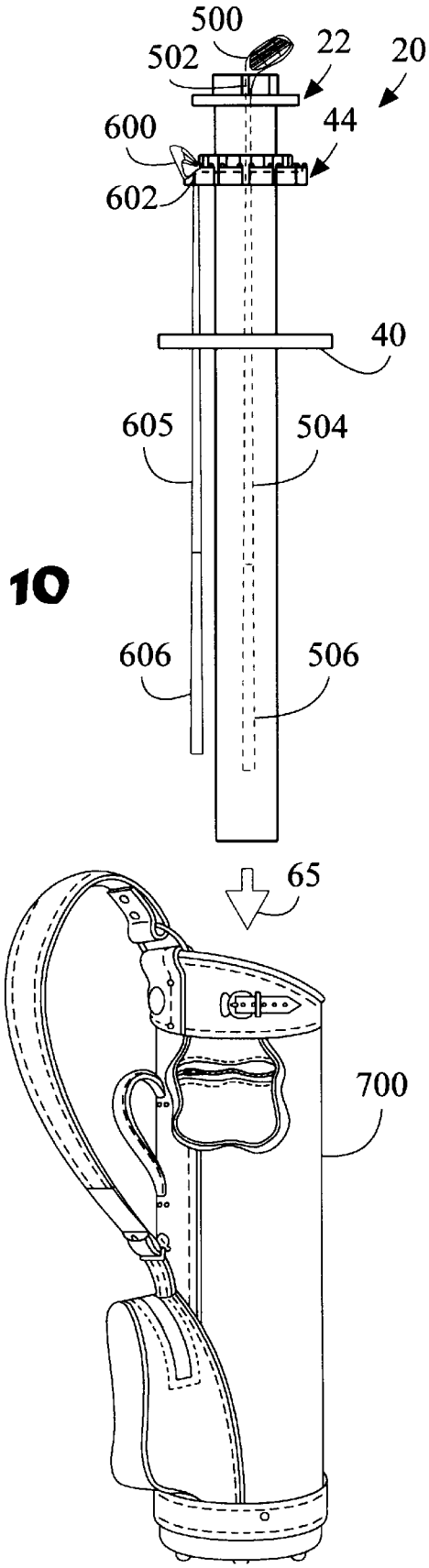
Fig. 10
Fig. 11
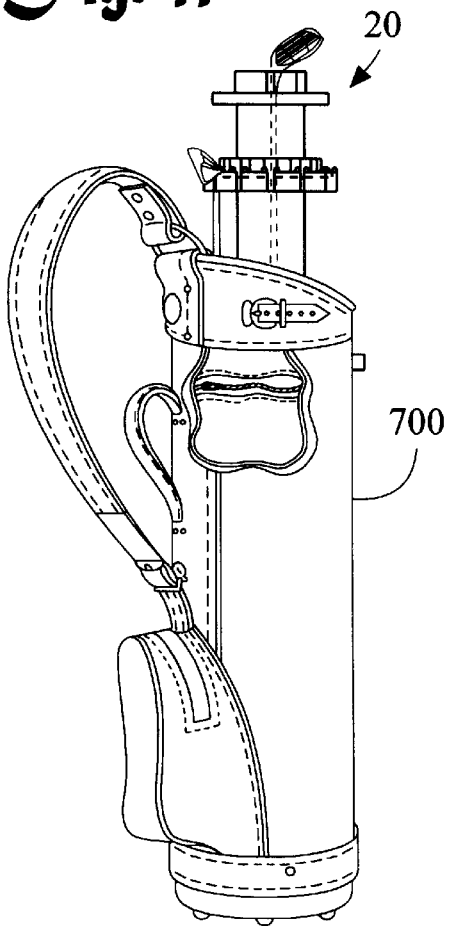

HOLDER FOR GOLF CLUBS

TECHNICAL FIELD

The present invention pertains generally to the game of golf, and more particularly to devices which hold golf clubs in a desired spaced relationship within a golf bag.

BACKGROUND ART

Devices for holding golf clubs within a golf bag are well known in the art. These devices typically include a plurality of separated stations into which individual golf clubs are placed. For example, U.S. Pat. No. 4,181,167 shows a club organizer for a golf bag. The organizer includes a round base provided with fourteen spaced tubes for receiving the end of the club shafts. Reflective elements are disposed relative to each tube to aid in locating the tubes. A club holder of resilient elastomeric material is secured to the top and has along its inner periphery a series of fourteen laterally spaced resilient notches communicating with an open center. The organizer is of a size suitable for insertion in a conventional golf bag. U.S. Pat. No. 4,753,446 illustrates a golf equipment carrier in which golf clubs are stored in an elongated generally cylindrical club receiving frame supported for rotation upon a base member. The frame comprises circular top and bottom members, with sockets for club shaft ends in the bottom member, and pockets in the top member for embracing the shanks of club shafts. A labyrinthine passage provides access into the pockets from the periphery of the top member. U.S. Pat. No. 5,366,075 defines an improved golf retaining device for holding golf clubs in place within a generally circular frame, while avoiding any bending stress transverse to the length of the club handle. A central disc of the club frame carries a band or ring of resilient material, e.g. a large O-ring, in a groove around the periphery of the disc. In locations where the club shafts pass this disc, the disc periphery has scallop-like recesses leaving the band without rearward support in those locations. U.S. Pat. No. 5,465,840 defines a golf bag, and methods of constructing and utilizing same. The apparatus supports a plurality of golf clubs and prevents the clubs from coming into damaging contact with each other while the clubs are being transported or stored, and facilitates the use and selection of the clubs during a round of golf. The apparatus comprises a holder mechanism having a plurality of separated storage compartments for receiving a plurality of golf clubs, each storage compartment isolating a golf club from contact with other golf clubs. A plurality of septa separate the stored golf clubs. U.S. Pat. No. 5,505,300 discloses a golf club divider insert and golf bag. The divider insert includes an elongated and sleeve-shaped member which is inserted within the golf bag and includes a plurality of elongated and circumferentially extending and spaced apart vanes which define a plurality of elongated enclosures within the bag for receiving the golf clubs. A plurality of foldable flap support members are hingedly attached to the plurality of vanes and each has a horizontal support ledge which allows the insert to be lifted a distance in the bag. U.S. Pat. No. 5,573,112 comprises a golf bag with inserted symmetrical full length divider. The device is of two-tube construction and has an outer tubular portion including a plurality of closable compartments. An inner tubular portion is provided having several embodiments of golf club storage configuration which helps circumferentially distribute the load from the weight of the clubs about the internal periphery of the golf bag. U.S. Pat. No. 5,613,603 consists of a golf club divider assembly for use with a golf bag for efficiently and conveniently housing a plurality of golf clubs with a conventional golf bag enclosure in a restraining and shielding fashion. A plurality of sleeve shaped member are inserted axially within the golf bag enclosure. A like plurality of divider members are slidably engaged within the sleeve shaped members and include radially projecting and axially extending vane portions which, upon insertion within the sleeve shaped members, create a plurality of club shaft receiving cavities.

DISCLOSURE OF INVENTION

The present invention is directed to a holder for golf clubs, the holder being of a size suitable for easy insertion into a golf bag. The holder securely holds up to four woods and 12 irons in separated spaced relationship during play, in transit, or in storage, and prevents the club heads and blades from interfering with or coming into damaging contact with each other or with external objects. The holder is particularly useful in motorized golf carts where the clubs may be damaged as a result of handling and vehicular motion. The holder also expedites play by allowing each club to be stored in a designated position or station, therefore eliminating the objectionable task of searching for a specific club.

The holder includes an upper rack for holding woods, a lower rack for holding irons, and a support tube to which the racks are bonded or otherwise connected. The length of the support tube and the placement of the racks on the tube, ensures that when the golf clubs are hung upon the racks, their grips will reside above the bottom of the golf bag. In a preferred embodiment the racks are circular, however other shapes can also be used. The racks are fabricated from a resilient non-abrasive plastic so that the clubs can be securely held without danger of damaging the surface of the clubs. In the storage position of the present invention, the heads of the woods and the blades of the irons are held inside the perimeter or "footprint" of the golf bag so that the clubs are protected from external objects. A centering means, consisting of either a wheel member or radial fins projects outward from the support tube, serves to center the holder in the golf bag. The holder can have different size centering means to permit use with various size golf bags. The holder may be freely rotated within the golf bag for easy club selection, or alternatively, can be fixedly installed.

The shafts and grips of wood golf clubs are received by the centrally located support tube, and the clubs are hung at the neck from the upper rack. The necks of the woods are received by sockets in the upper rack, and the heads reside in valleys or pockets which prevent the heads from rotating and striking the head of an adjacent club. By using the present invention, the need for time consuming individual club head covers is eliminated.

Similarly, the iron golf clubs are hung at the neck from sockets in the lower rack. In the storage position, the blade of each iron is held in close proximity to the support tube by a pair of pegs. In the playing position, the blade of the clubs project outwardly from the support tube thereby providing easy access during play.

In accordance with a preferred embodiment of the invention, a holder for golf clubs includes a substantially planar upper rack having a first central hole. The first central hole is surrounded by and contiguous with a first plurality of golf club neck receiving sockets. The upper rack has a top side having a plurality of mesas interspersed with the first plurality of sockets, the mesas forming a first plurality of golf club head receiving valleys or pockets therebetween. The upper rack has a bottom side. A support tube having an inner perimeter is perpendicularly connected to the bottom side, the first central hole and the first plurality of golf club neck receiving sockets being surrounded by the inner perimeter.

In accordance with an important aspect of the invention, the upper rack is circular.

In accordance with an important feature of the invention, the upper rack includes four golf club neck receiving sockets suitable to receive four wood golf clubs.

In accordance with another aspect of the invention, the upper rack is fabricated from a resilient polymer.

In accordance with another feature of the invention, when the golf club is inserted into one golf club neck receiving socket, the golf club head resides in one valley and abuts two mesas, the mesas holding the golf club head in a fixed position.

In accordance with another important aspect of the invention, when the golf club holder is inserted into a golf bag having an outer perimeter, the inserted golf club head resides inside the outer perimeter of the golf bag.

In accordance with another important feature of the invention, the support tube is cylindrical.

In accordance with another aspect of the invention, the support tube has a centering means for centering the holder within a golf bag.

In accordance with another preferred embodiment of the invention, the golf club holder further includes a lower rack having a band member having a second central hole. The band member has an outer perimeter having a plurality of spaced vertical flutes interspersed with a plurality of outward segments. A balcony is connected to and integral with each outward segment, the balcony having a top surface. The flutes and the balconies forming a second plurality of golf club neck receiving sockets. Two golf club retaining pegs are disposed on the top surface of each balcony. The support tube is received by the second central hole.

In accordance with an important aspect of the invention, each golf club blade has a top edge, wherein when the golf club is inserted into one golf club neck receiving socket, the top edge rests upon the top surface between the pegs, the golf club being retained by the pegs.

In accordance with an important feature of the invention, when the golf club holder is inserted into a golf bag having an outer perimeter, the golf club blade resides inside the outer perimeter of the golf bag.

In accordance with an important aspect of the invention, each golf club having a blade having a top edge, wherein when the golf club is inserted into one golf club neck receiving socket, the top edge resides between two adjacent balconies.

In accordance with another important aspect of the invention, the lower rack includes 12 golf club neck receiving sockets.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 10 is a reduced side elevation view of the holder ready for insertion into a golf bag;

FIG. 11 is a reduced side elevation view of the holder inserted into the golf bag;

MODES FOR CARRYING OUT THE INVENTION

Figure 1:
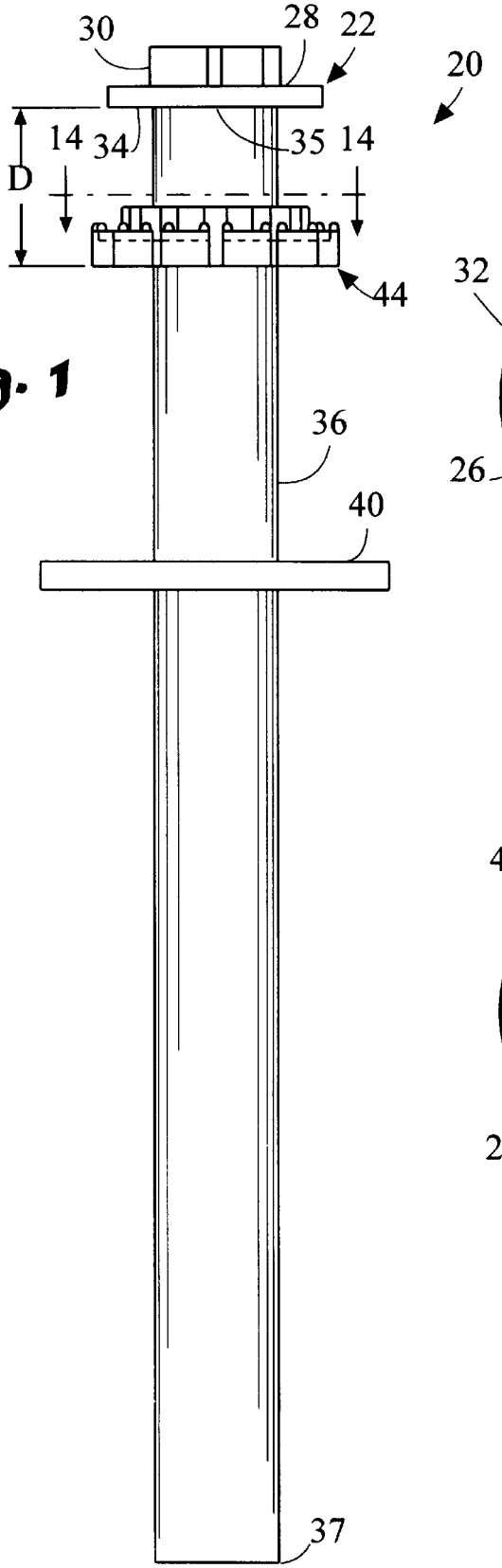
FIG. 1 is a side elevation view of a holder for golf clubs in accordance with the present invention.
Figure 2:
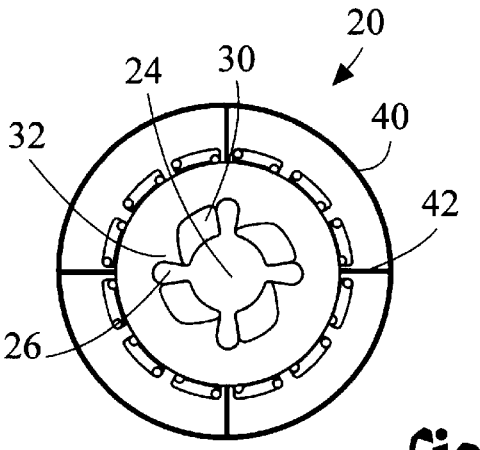
FIG. 2 is a top plan view of the holder.
Figure 3:
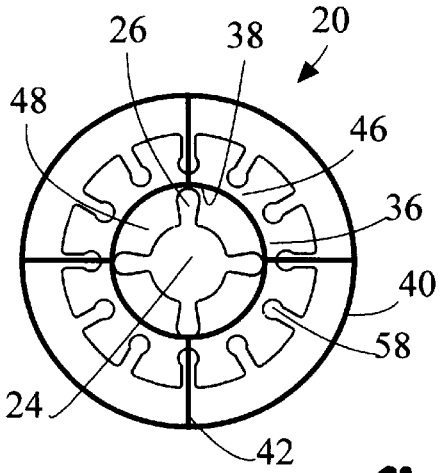
FIG. 3 is a bottom plan view of the holder.
Figure 4:
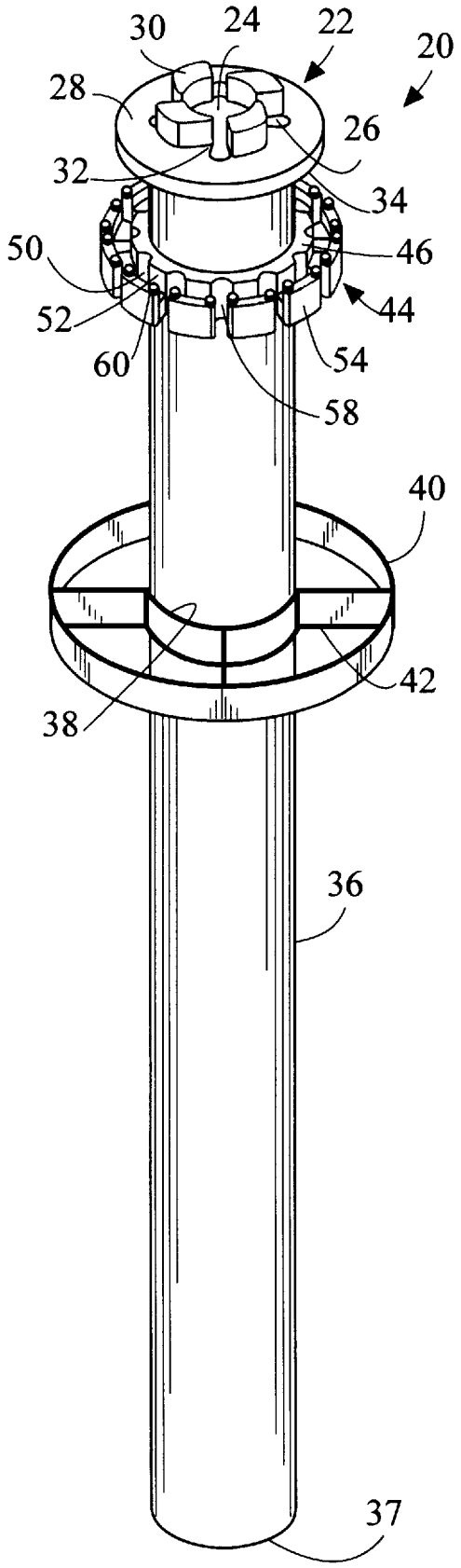
FIG. 4 is a perspective view of the holder.

Referring initially to FIGS. 1–4 there are illustrated side elevation, top plan, bottom plan, and perspective views respectively of a holder for golf clubs in accordance with the present invention, generally designated as 20. Holder 20 consists of an upper rack 22 having a first plurality of golf club neck receiving sockets 26. A support tube 36 has a first end 35 and an opposite second end 37. Upper rack 22 is connected to first end 35. A lower rack 44 is connected to support tube 36 a spaced predetermined distance D from upper rack 22. It is noted that the terms upper rack 22 and lower rack 44 apply to holder 20 when it is in a substantially vertical position with second end 37 resting upon a supporting surface. It is also noted that in the shown preferred embodiment upper rack 22 and lower rack 44 are comprised of a plurality of symmetrically spaced identical elements. Therefore, in the interest of clarity, the drawings do not include reference numerals for all elements, but typically rather highlight only one of the plurality.

Figure 5:
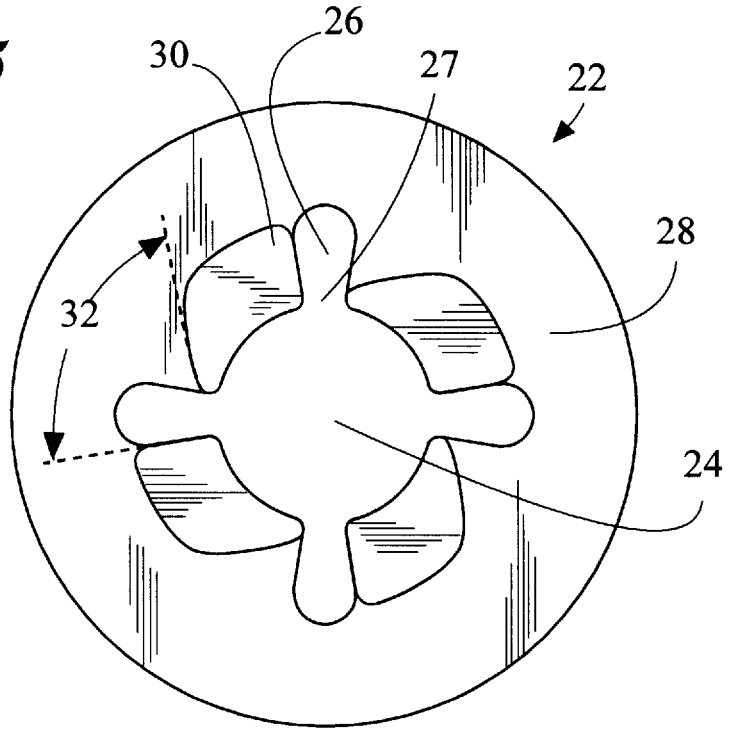
FIG. 5 is an enlarged top plan view of an upper rack.
Figure 6:
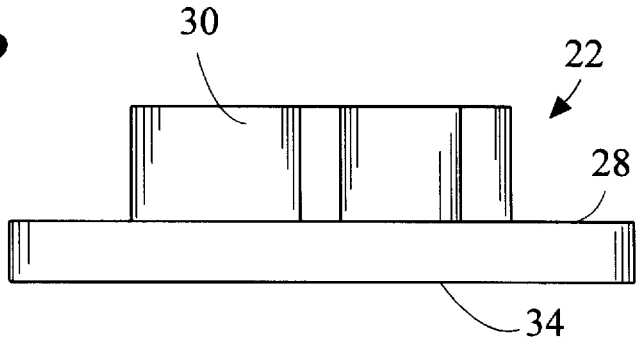
FIG. 6 is an enlarged side elevation view of the upper rack.
Figure 12:
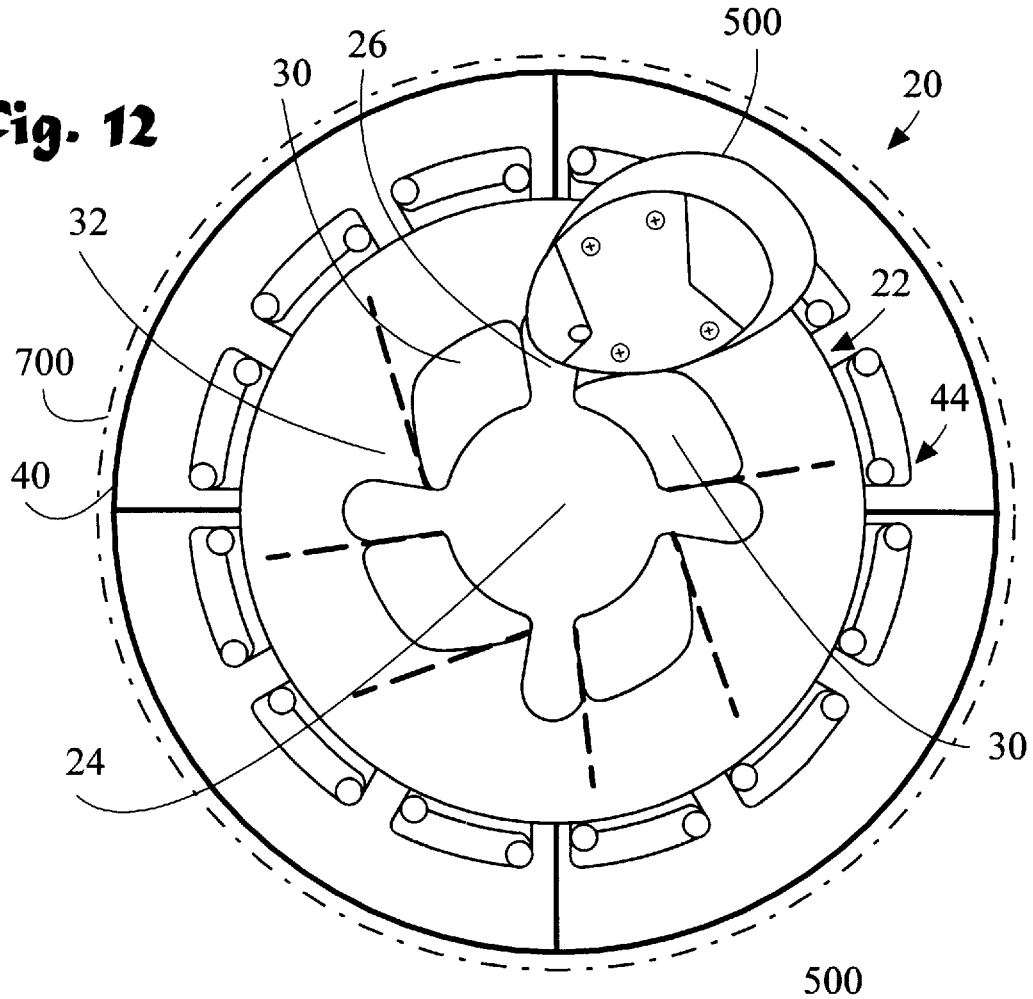
FIG. 12 is an enlarged top plan view of the holder with a wood golf club inserted into the upper rack.
Figure 13:
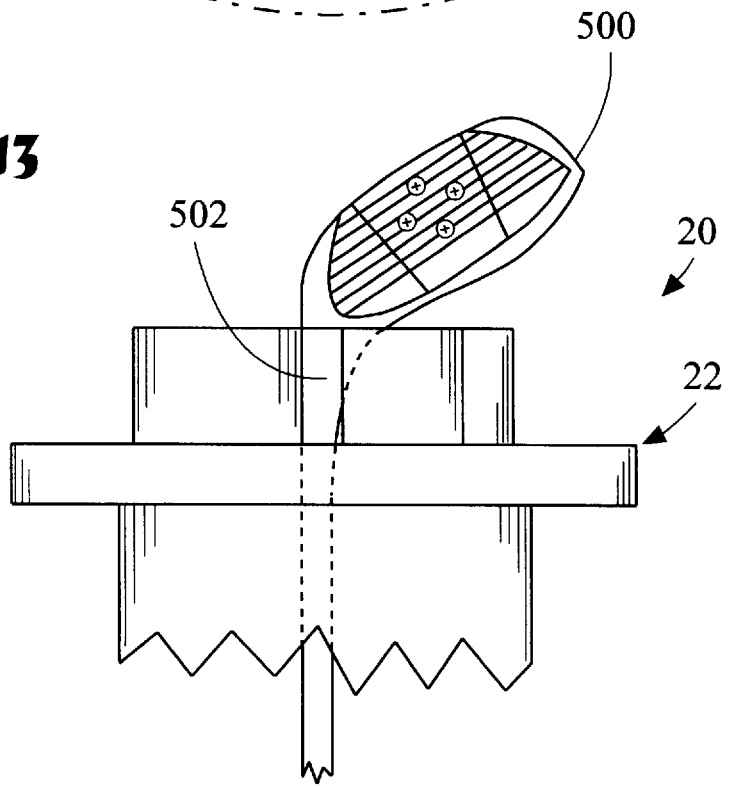
FIG. 13 is an enlarged fragmented side elevation view of the wood golf club inserted into the upper rack.

Upper rack 22 is substantially planar and has a first central hole 24 (also refer to FIGS. 5 and 6). In a preferred embodiment, upper rack 22 is circular since that shape offers the largest club-storing perimeter for a given cross sectional area. However, other shapes such as rectangular or oval could also be utilized. First central hole 24 is surrounded by and contiguous with the first plurality of golf club neck receiving sockets 26. In the shown preferred embodiment, there are four golf club neck receiving sockets 26. FIGS. 12 and 13 show a wood golf club inserted into upper rack 22. The wood golf club has a head 500 and a neck 502. Sockets 26 have a narrow mouth portion 27 which is slightly smaller than neck 502, so that neck 502 may be pressed or snapped into socket 26 and retained thereby. Upper rack 22 is fabricated from a resilient polymer such as polyurethane, which permits the neck 502 to enter socket 26 through narrow mouth portion 27.

Upper rack 22 has a top side 28. A plurality of mesas 30 are disposed on top side 28, the mesas 30 being interspersed with the first plurality of sockets 26. The number of mesas 30 is equal to the number of sockets 26, and is four in the shown preferred embodiment. The mesas 30 form a plurality (four in the shown embodiment) of valleys 32 which receive the head 500 of a wood golf club. Upper rack 22 has a bottom side 34. Hollow support tube 36 having an inner perimeter 38 is perpendicularly connected to bottom side 34. In the shown preferred embodiment, support tube 36 is cylindrical, however other shapes could also be utilized. First central hole 24 and first plurality of golf club neck receiving sockets 26 are surrounded by inner perimeter 38 of support tube 36, so that the shaft of a golf club can be downwardly inserted into support tube 36, and the neck 502 then horizontally inserted, or snapped, into one of the sockets 26. When the wood golf club is inserted into one of the golf club neck receiving sockets 26, golf club head 500 resides in one valley 32 and abuts the two adjacent mesas 30, so that the golf club head 500 is held in a fixed position by the resilient mesas 30. Referring to FIG. 12, when golf club holder 20 is inserted into a golf bag 700 having an outer perimeter or "footprint", head 500 resides inside the perimeter of the golf bag 700. This is useful in that it protects head 500 when the golf bag 700 is placed in a horizontal position on the ground.

Support tube 36 has a centering means for centering holder 20 within a golf bag (also refer to FIG. 12). In the embodiment shown the centering means includes a wheel-shaped member 40 having a plurality of spokes 42. Wheel member 40 surrounds support tube 36 and is connected to support tube 36 by spokes 42. Wheel member 40 can be of various diameters so as to fit in different size golf bags.

Figure 7:
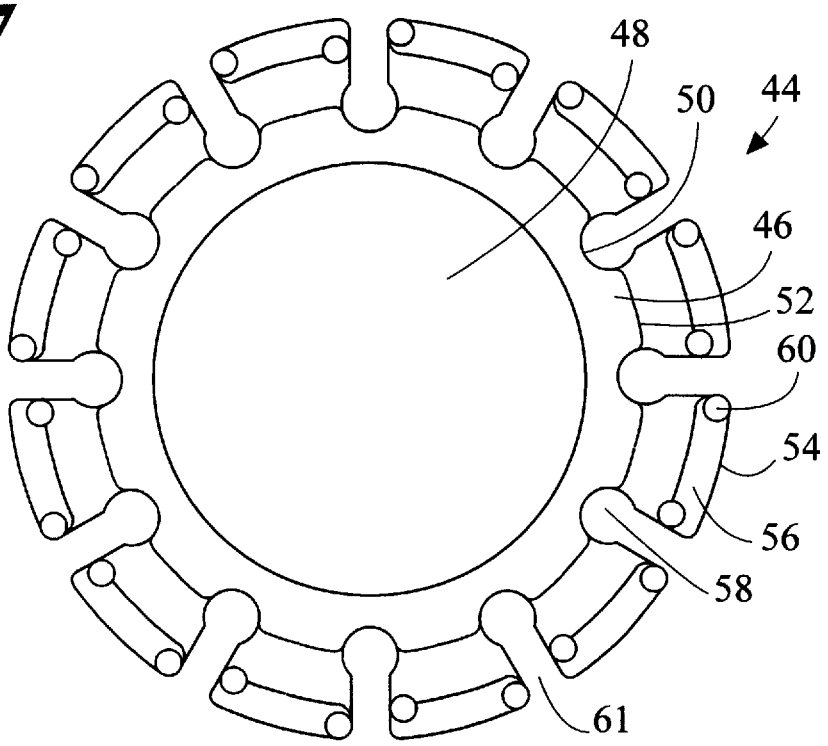
FIG. 7 is an enlarged top plan view of a lower rack.
Figure 8:
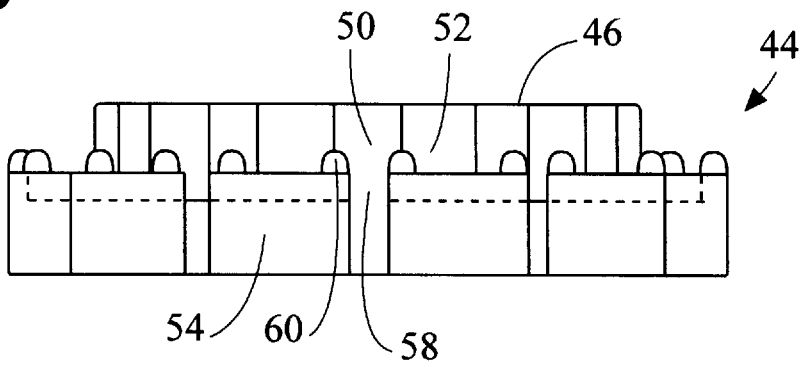
FIG. 8 is an enlarged side elevation view of the lower rack.

Holder 20 further includes a lower rack 44 having a band member 46 having a second central hole 48 (refer also to FIGS. 7 and 8). Band member 46 encircles support tube 36 which is received by second central hole 48. In a preferred embodiment band member 46 and second central hole 48 are circular, and second central hole 48 fixedly receives support tube 36. Band member 46 has an outer perimeter which is comprised of a plurality of spaced vertical flutes 50 interspersed with a plurality of outward segments 52. A balcony 54 having a top surface 56 is connected to each outward segment 52. Balconies 54 and flutes 50 form a second plurality of golf club neck receiving sockets 58, in this case the sockets are designed to receive iron golf clubs. Two club retaining pegs 60 are disposed on top surface 56 of each balcony 54. In the shown embodiment, balconies 54 are L-shaped, however they could also extend straight out from outward segments 52.

Figure 14:
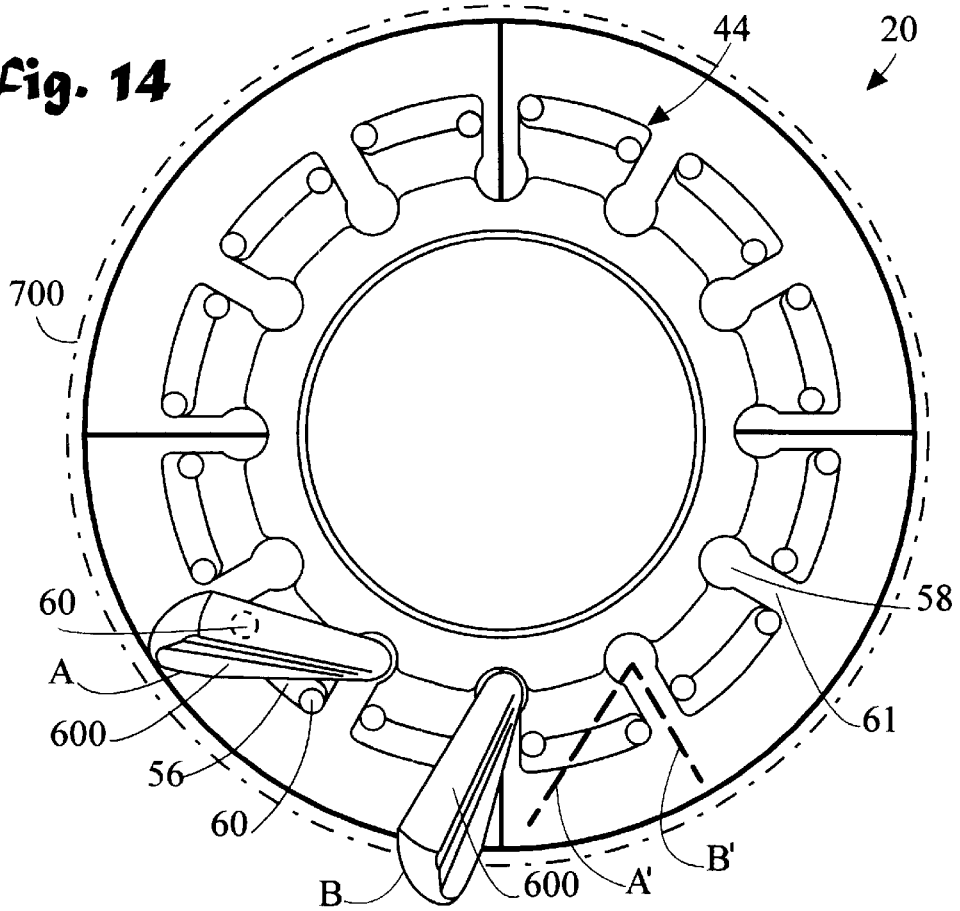
FIG. 14 is an enlarged view of the lower rack with iron golf clubs inserted therein, along the line 14—14 of FIG. 1.
Figure 15:
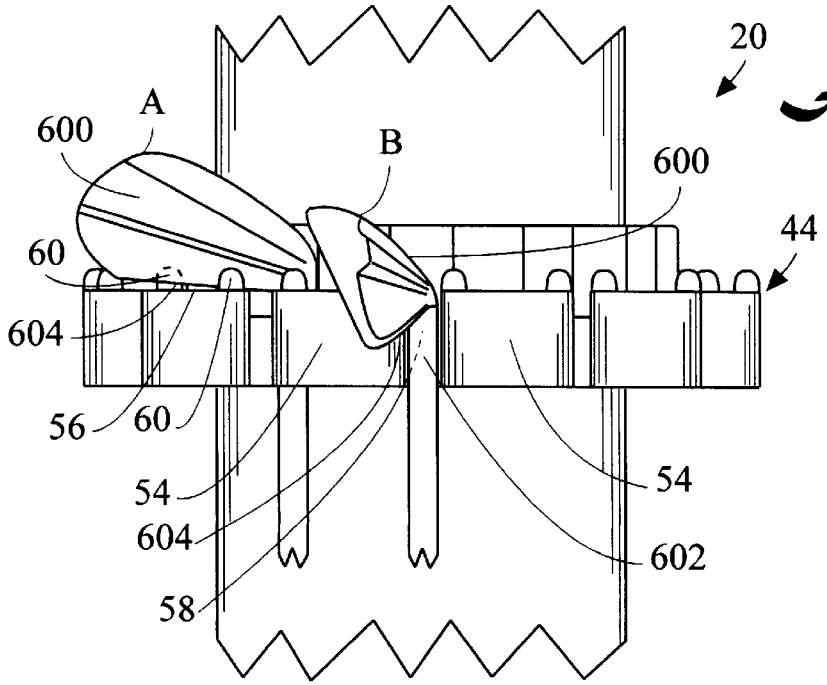
FIG. 15 is an enlarged fragmented side elevation view of the lower rack with iron golf clubs inserted therein.

In a preferred embodiment, lower rack 44 is circular since that shape offers the largest club-storing perimeter for a given cross sectional area. However, other shapes such as rectangular or oval could also be utilized. In the shown preferred embodiment, there are 12 iron golf club neck receiving sockets 58. FIGS. 14 and 15 show two iron golf clubs inserted into lower rack 44. Each iron golf club has a blade 600 and a neck 602, blade 600 having a top edge 604. Iron golf club A is in the storage position. When iron golf club A is inserted into one of the golf club neck receiving sockets 58, top edge 604 rests upon top surface 56 between the two pegs 60 which retain the golf club in the shown stored position. Line A' shows the position of top edge 604 in the storage position for another socket 58. It is noted that in the storage position, when holder 20 is inserted into a golf bag 700 having an outer perimeter, golf club blade 600 resides inside the perimeter of the golf bag 700. This is useful in that it protects blade 600 when the golf bag 700 is placed in a horizontal position on the ground. Iron golf club B is in the playing position. When iron golf club B is inserted into one of the golf club neck receiving sockets 58, top edge 604 resides slightly below the storage position and between two adjacent balconies 54. In this outwardly extending position, the club blade 600 is easy for a player to access during play. Line B' shows the position of top edge 604 in the playing position.

Sockets 58 have a narrow mouth portion 61 which is slightly smaller than neck 602, so that neck 602 may be pressed or snapped into socket 58 and retained thereby. Lower rack 44 is also fabricated from a resilient polymer such as polyurethane, which permits the neck 602 to enter socket 58 through narrow mouth portion 61.

In terms of use, referring to FIGS. 12–15, holder 20 is placed in a substantially vertical position with upper rack 22 above support tube 36. A wood golf club having a head 500, a neck 502, a shaft 504, and a grip 506 opposite to head 500 is inserted into first central hole 24 grip down (refer also to FIG. 10). Neck 502 is then horizontally inserted into one of the first plurality of golf club neck receiving sockets 26. Head 500 is then pressed down into one valley 32 so that head 500 abuts two adjacent mesas 30 and is held in a fixed position. For iron golf clubs having a blade 600 having a top edge 604, a neck 602, a shaft 605, and a grip 606 opposite blade 600, the iron golf club is inserted grip down into one of the second plurality of golf club neck receiving sockets 58. The iron golf club is then lowered until neck 602 resides between two adjacent balconies 54. This constitutes the playing position. For the storage position, the iron golf club is positioned so that top edge 604 rests upon the top 56 of one of the balconies 54 between two pegs 60.

FIG. 5 is an enlarged top plan view of upper rack 22, and FIG. 6 is an enlarged side elevation view of upper rack 22.

FIG. 7 is an enlarged top plan view of lower rack 44, and FIG. 8 is an enlarged side elevation view of lower rack 44.

Figure 9:
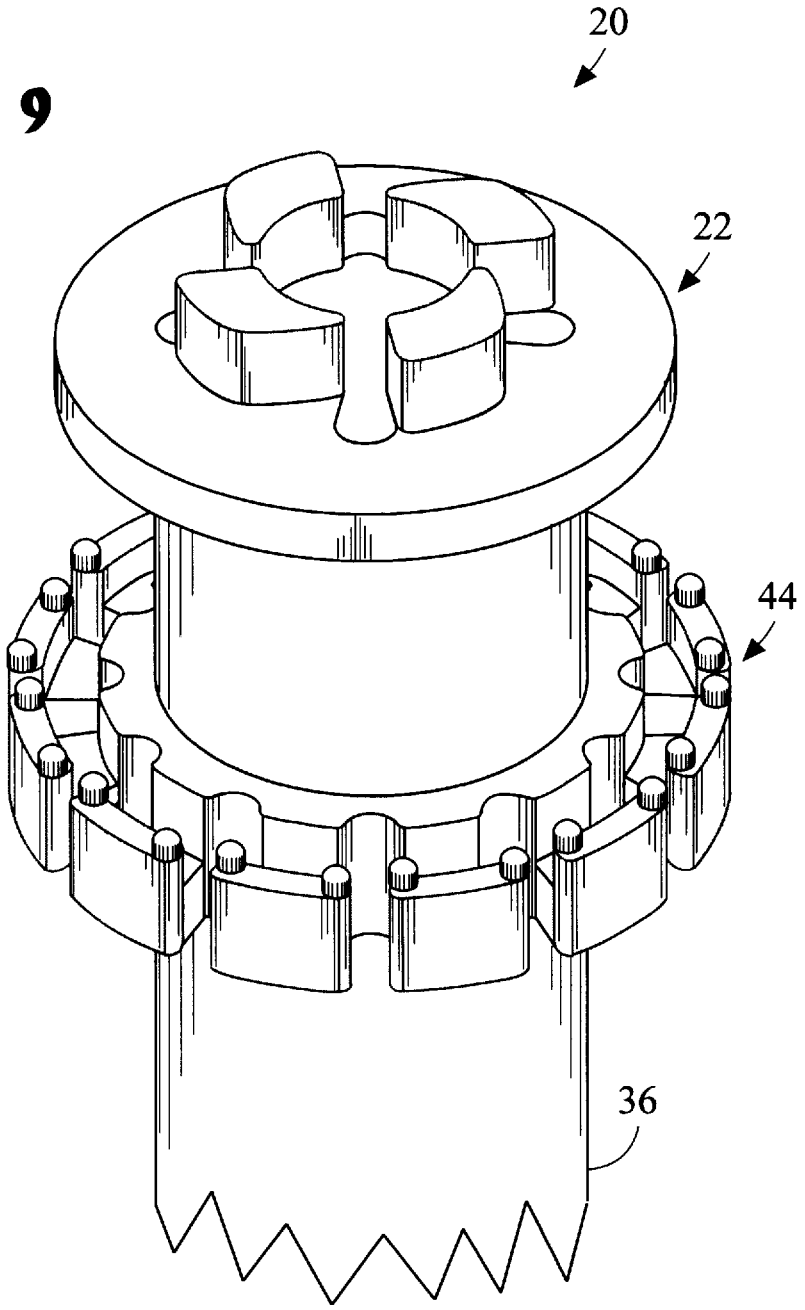
FIG. 9 is an enlarged fragmented perspective view of the upper rack and the lower rack connected to a support tube.

FIG. 9 is an enlarged fragmented perspective view of the upper rack and the lower rack connected to support tube 36. The connection can be effected either by a bonding agent or by other mechanical means.

FIG. 10 is a reduced side elevation view of holder 20 ready for insertion into a golf bag 700. Holder 20 is inserted into bag 700 in direction 65. Centering means 40 ensures that holder 20 is centered within golf bag 700.

FIG. 11 is a reduced side elevation view of holder 20 inserted into golf bag 700.

FIG. 12 is an enlarged top plan view of holder 20 with a wood golf club inserted into upper rack 22.

FIG. 13 is an enlarged fragmented side elevation view of the wood golf club inserted into upper rack 22.

FIG. 14 is an enlarged view of lower rack 44 with iron golf clubs inserted therein, along the line 14—14 of FIG. 1. Club A is in the storage position, and club B is in the playing position.

FIG. 15 is an enlarged fragmented side elevation view of lower rack 44 with iron golf clubs inserted therein.

Figure 16:
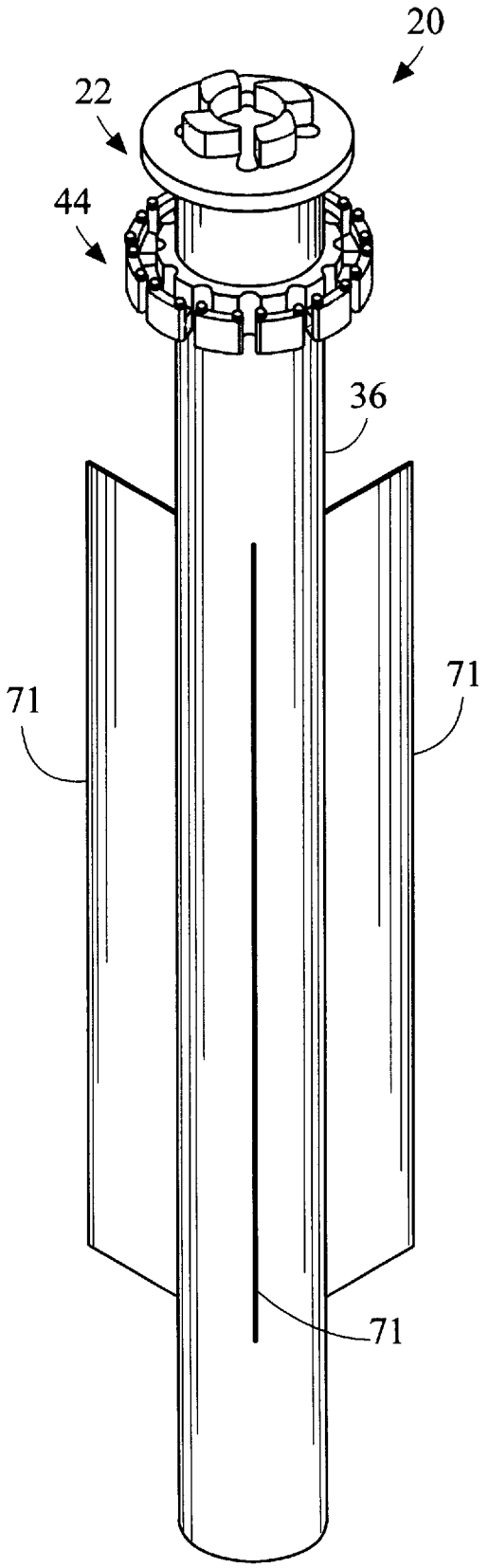
FIG. 16 is a perspective view of the holder showing a second embodiment of a centering means; and, FIG. 17 is a perspective view of the holder showing it inserted in a golf bag.

FIG. 16 is a perspective view of the holder showing a second embodiment of the centering means. A plurality of vanes 71 project outwardly from support tube 36. Vanes 71 can be of various sizes to fit in different size golf bags.

Figure 17:
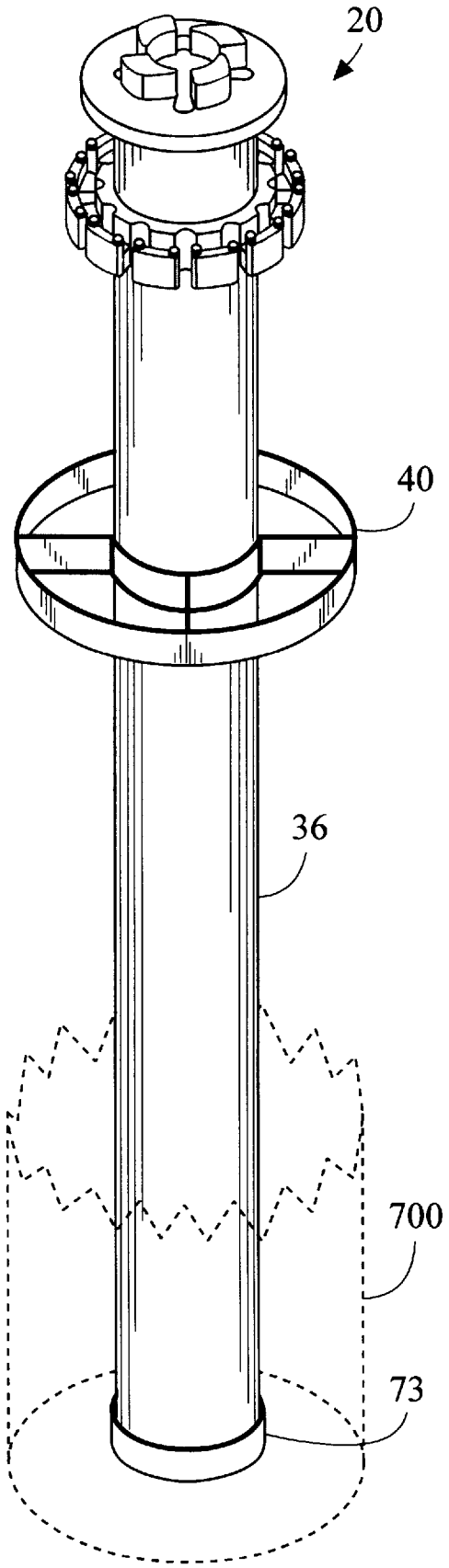

FIG. 17 is a perspective view showing holder 20 inserted into a golf bag 700. A cup 73 is attached to golf bag 700 and receives support tube 36. Cup 73 serves to retain holder 20 in the center of golf bag 700.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A holder for golf clubs, each wood golf club having a head and a neck, and each iron golf club having a blade with a top edge and a neck, comprising:

a substantially planar upper rack having:

a first plurality of golf club neck receiving sockets;

a first central hole surrounded by and contiguous with said first plurality of golf club neck receiving sockets;

a top side;

a plurality of mesas disposed on said top side interspersed with said first plurality of golf club neck receiving sockets, said plurality of mesas forming a plurality of valleys therebetween; and, a bottom side;

a support tube having:

a first end;

an opposite second end; and, an inner perimeter perpendicularly connected to said bottom side of said upper rack, said first central hole and said first plurality of golf club neck receiving sockets surrounded by said inner perimeter; and, a lower rack having a second plurality of golf club neck receiving sockets and connected to said support tube a spaced predetermined distance from said upper rack.

2. A holder for golf clubs according to claim 1, wherein said upper rack is circular.

3. A holder for golf clubs according to claim 1, wherein when a wood golf club is inserted into one of said first plurality of golf club neck receiving sockets, the golf club head resides in one of said plurality of valleys and abuts two of said plurality of mesas, said two of said plurality of mesas holding the golf club head in a fixed position.

4. A holder for golf clubs according to claim 3, wherein when said golf club holder is inserted into a golf bag having an outer perimeter, the golf club head resides inside the outer perimeter of the golf bag.

5. A holder for golf clubs according to claim 1, further including;

said lower rack having a band member having a second central hole;

said band member having an outer perimeter having a plurality of spaced vertical flutes interspersed with a plurality of outward segments;

a balcony connected to each outward segment, said balcony having a top surface;

said flutes and said balconies forming said second plurality of golf club neck receiving sockets;

two golf club retaining pegs disposed on said top surface of each said balcony, and, said support tube received by said second central hole.

6. A holder for golf clubs each wood golf clubs, having a blade and a neck and each iron golf club having a blade with a top edge and a neck, comprising:

an upper rack having a first plurality of golf club neck receiving sockets and a first central hole;

a lower rack having:

a second plurality of golf club neck receiving sockets;

a band member having a second central hole;

said band member having an outer perimeter having a plurality of spaced vertical flutes interspersed with a plurality of outward segments;

a balcony connected to each outward segment, said balcony having a top surface;

said flutes and said balconies forming said second plurality of golf club neck receiving sockets; and, two golf club retaining pegs disposed on said top surface of each said balcony; and, a support tube having a first end connected to said upper rack and an opposite second end; and, said support tube received by said second central hole connecting said lower rack to said support tube a spaced predetermined distance from said upper rack.

7. A holder for golf clubs according to claim 6, wherein when a golf club is inserted into one of said second plurality of golf club neck receiving sockets, the top edge rests upon one of said top surface between said two golf club retaining pegs, the golf club being retained by said two golf club retaining pegs.

8. A holder for golf clubs according to claim 7, wherein when said golf club holder is inserted into a golf bag having an outer perimeter, the golf club blade resides inside the outer perimeter of the golf bag.

9. A holder for golf clubs according to claim 6, wherein when the golf club is inserted into one of said second plurality of golf club neck receiving sockets, the top edge resides between two of said adjacent balconies.

10. A holder for golf clubs according to claim 6, further including:

said upper rack being substantially planar and having a first central hole;

said first central hole surrounded by and contiguous with said first plurality of golf club neck receiving sockets;

said upper rack having a top side, a plurality of mesas disposed on said top side interspersed with said first plurality of sockets, said mesas forming a plurality of valleys therebetween; and, said upper rack having a bottom side, said support tube having an inner perimeter perpendicularly connected to said bottom side, said first central hole and said first plurality of golf club neck receiving sockets surrounded by said inner perimeter.

11. A holder for golf clubs according to claim 10, wherein said upper rack is circular.

12. A holder for golf clubs according to claim 10, wherein when a wood golf club having a head is inserted into one of said second plurality of golf club neck receiving sockets, the golf club head resides in one of said plurality of valleys and abuts two of said plurality of mesas, said two of said plurality of mesas holding the golf club head in a fixed position.

13. A holder for golf clubs according to claim 12, wherein when the holder is inserted into a golf bag having an outer perimeter, the golf club head resides inside the outer perimeter of the golf bag.

14. A holder for golf clubs according to claim 6, said and member and said second central hole being circular.

* * * * *